United States Patent [19]

Delfino

[11] 4,307,183

[45] Dec. 22, 1981

[54] SILVER HALIDE PHOTOGRAPHIC EMULSIONS INCLUDING DYE SENSITIZERS AND SUPERSENSITIZING OR STABILIZING AMOUNTS OF A POLYMERIC COMPOUND AND PHOTOGRAPHIC ELEMENTS, PARTICULARLY RADIOGRAPHIC ELEMENTS INCLUDING SAID EMULSIONS

[75] Inventor: Gerolamo Delfino, Ferrania/Savona, Italy

[73] Assignee: Minnesota Mining and Manufacturing Company, St. Paul, Minn.

[21] Appl. No.: 196,574

[22] Filed: Oct. 14, 1980

[30] Foreign Application Priority Data

Oct. 12, 1979 [IT] Italy ..... 50551 A/79

[51] Int. Cl.[3] ..... G03C 1/76; G03C 1/14

[52] U.S. Cl. ..... 430/495; 430/523; 430/572; 430/576; 430/627; 430/961; 430/966

[58] Field of Search ..... 430/576, 572, 627, 495, 430/966, 523, 961

[56] References Cited

U.S. PATENT DOCUMENTS

| | | | |
|---|---|---|---|
| 2,860,981 | 11/1958 | Jones | 430/572 |
| 4,040,825 | 8/1977 | Steiger et al. | 430/576 |
| 4,172,730 | 10/1979 | Hinata et al. | 430/966 |

*Primary Examiner*—J. Travis Brown

*Attorney, Agent, or Firm*—Cruzan Alexander; Donald M. Sell; Mark A. Litman

[57] ABSTRACT

Object of the invention are photographic emulsions including silver halide grains dispersed in gelatin and at least a methine dye spectral sensitizer associated with said grains, including in association therewith a supersensitizing or stabilizing amount of a polymeric compound having an aminoallylidenmalononitrile moiety. The invention further relates to photographic elements, in particular radiographic elements, comprising said emulsions. According to the invention, said polymeric compound is obtained upon copolymerization of an allyl monomer, comprising said aminoallylidenmalononitrile moiety, with an ethylenically unsaturated monomer.

11 Claims, No Drawings

SILVER HALIDE PHOTOGRAPHIC EMULSIONS INCLUDING DYE SENSITIZERS AND SUPERSENSITIZING OR STABILIZING AMOUNTS OF A POLYMERIC COMPOUND AND PHOTOGRAPHIC ELEMENTS, PARTICULARLY RADIOGRAPHIC ELEMENTS INCLUDING SAID EMULSIONS

DESCRIPTION

1. Technical Field

The present invention relates to photographic emulsions including silver halide grains dispersed in gelatin associated with methine dye spectral sensitizer and with sensitizing or stabilizing amounts of a polymeric compound and to photographic elements, particularly radiographic elements including said emulsions.

2. Background Art

It is well-known in the art of making photographic emulsions to incorporate cyanine dyes to extend the spectral sensitivity of silver halide emulsions. This is generally known in the art as represented by U.S. Pat. Nos. 2,912,329, 3,397,060, 3,573,916, 3,822,136 and FR Pat. No. 1,108,778. Such dyes, in combination with each other or with certain other compounds, markedly increase the sensitivity of photographic emulsions with respect to the dyes used individually in such emulsions, thus causing an effect called "supersensitization". This is well discussed in "The Theory of Photographic Process", 3rd Edition, Mees and James, 1966, pp. 253–271.

It is further known that the sensitivity of a spectrally sensitized emulsion may result lower than expected when the coating (liquid) composition has been stored at high temperatures, which fact may be due to an unstable association of the dye sensitizers with the silver halide grains (in this sense the emulsion can be said to be unstable).

DISCLOSURE OF THE INVENTION

Now, it has been found that a marked increase in sensitivity is obtained by associating with the silver halide grains of a photographic emulsion at least one cyanine dye spectral sensitizer in supersensitizing combination with certain polymeric products containing an aminoallylidenmalononitrile ($>N-CH=CH-CH=C(CN)_2$). It has been further found that the "stability" of the emulsion containing said supersensitizing combination is significantly enhanced.

Such combination proved to be particularly useful in the case of X-ray emulsions including spectral sensitizers, as recently developed in the art, such emulsions being coated on both sides of a support (polyester) base and overcoated with a protective (gelatin) layer for light exposure within a radiographic cassette including intensifying phosphor screens normally emitting a blue and green light (or even red, but not so normally) upon X-ray exposure.

It is further believed that such combination is particularly useful when the dye sensitizer molecules form intramolecular betaine salts which are likely to render them more easily displaced from silver halide grains on which they are adsorbed.

Accordingly, the present invention relates to a photographic emulsion including silver halide grains dispersed in gelatin and at least one methine dye spectral sensitizer associated with said grains including, associated therewith, a supersensitizing or stabilizing amount of a polymeric compound including an aminoallylidenmalononitrile moiety.

Particularly, the present invention refers to a photographic emulsion as per above, in which said polymeric compound is obtained upon copolymerization of an allyl monomer which has an ethylenically condensed aminoallyliden malononitrile moiety therein with an ethylenically unsaturated monomer, said monomer being preferably a water soluble monomer; said copolymerization being preferably a solution copolymerization; said polymeric compound preferably being a water soluble compound; said monomer more preferably being an acrylic or methacrylic monomer, most preferably being acrylamide or acrylic acid.

Still particularly, the present invention refers to a photographic emulsion as per above, in which said dye sensitizer has the following formula:

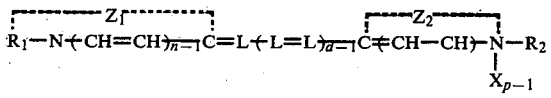

wherein n, m and p each represent 1 or 2; L represents a methine linkage; $R_1$ and $R_2$ each represent a substituted or non-substituted alkyl or an aryl group, preferably of less than 20 carbon atoms; X represents any acid anion; d represents 1, 2 or 3; p represents 1 or 2; said $R_1$ and/or $R_2$ groups forming an intramolecular betaine salt when p is 1; $Z_1$ and $Z_2$ each represent the non-metallic atoms, preferably selected from C, O, N and S, necessary to form a simple or condensed 5 or 6-membered heterocyclic nucleus.

More particularly, the present invention refers to cyanine dyes particularly useful for sensitizing to the green light, preferably to carbocyanine dyes derived from the benzoxazole nucleus attached through the trimethine chain either to another benzoxazole nucleus or to a benzomidazole nucleus.

Still more preferably, the present invention refers to cyanine dyes of the type forming an intramolecular betaine salt within the dye molecule (such as when $R_1$ and $R_2$ groups, as above defined, are alkyl groups substituted with sulphonic groups and are attached to a nitrogen atom bearing a positive charge).

As before indicated, the polymeric compounds of the present invention are preferably prepared by solution copolymerization of an allyl monomer including an allylidenmalononitrile moiety, preferably a diallylaminoallylidenmalononitrile monomer, with a water soluble ethylenically unsaturated monomer. Acrylic monomers such as acrylamide and the low N-alkyl derivatives thereof (such as N-methyl-acrylamide, N-ethylacrylamide, N,N-dimethylacrylamide); methacrylamide and the low N-alkyl derivatives thereof (such as N-methyl-methacrylamide, N-ethylmethacrylamide and N,N-dimethylmethacrylamide); acrylic acid and methacrylic acid have been found to be particularly suitable to react with said 3-diallylaminoallylidenmalononitrile compound to obtain copolymers soluble in water having the desired supersensitizing or stabilizing characteristics. Other suitable (non-acrylic) monomers may be styrensulfonic acid, N-valerolactame, N-vinyl-pyrrolidone, N-vinyloxazolidone, N-vinylsuccinimide and maleimide. As known to the man skilled in the art, the copolymerization can be performed in a single batch, by reacting both monomers in the suitable solvent with the suitable polymerization initiator and isolating the obtained copolymer, or, alternatively, by adding, at intervals of time, the reaction mass (consisting of both monomers and the polymerization initiator dissolved in a solvent) with the ethylenically unsaturated monomer (more reactive than the allyl monomer) and with the polymerization initiator, so as to control the polymer composition (as usually done by those skilled in the art when monomers, having different reactivities, are to be copolymerized). Useful polymeric compounds can also be obtained upon copolymerization of the allyl monomer with more than one ethylenically unsaturated monomers, e.g. acrylamide and allylamine chlorohydrate or diallylamine chlorohydrate. The obtained copolymers may normally have an intrinsic viscosity (in $NaNO_3$ 1N at 30° C.) of 0.01 to 0.5 dl/g, preferably of 0.02 to 0.1 dl/g, higher or lower values being anyhow chosen for particular aims and they can be added to the photographic layers from water solutions. In the case of an emulsion copolymerization, vinylic esters, such as e.g. vinylacetate, vinylpropionate and vinylbutyrate, styrene and, preferably, acrylic or methacrylic acid esters, such as e.g. methylacrylate, ethyl acrylate, 2-ethylhexylacrylate and the analogous esters of the methacrylic acid have been found to be particularly suitable monomers. The term "copolymer", as used herein, includes the product of copolymerization of at least two moieties so as to include terpolymers, etc. The obtained copolymer latexes are also useful to the purposes of the present invention, but are less effective than the polymeric compounds prepared upon solution copolymerization, as before described. It is difficult to provide a well-defined structure formula to the copolymers of the present invention (an uncertainty is recognized in the literature pertinent to the structure of polymers derived from diallylamine, such as e.g. described in Aust. J. Chem., 29, 315 (1976) and J. Macromol. Sci. Chem., A 10, 875 (1976)). For the copolymers of diallylaminoallylidenmalononitrile and of the acrylic monomer of the present invention, the examination of the IR and NMR spectra has shown a strong evidence for a structure containing aliphatic carbon atoms in a pyrrolidine cyclic ring, even if the contemporary presence of a piperidine cyclic ring cannot be excluded. The presence of the aminoallylidenmalononitrile moieties has been anyhow noticed. They can be present in a varying measure with limits easily determinable for the purposes of the present invention. With a content lower than 3% w/w, the copolymers are thought to be less effective to the purposes of the supersensitizing or stabilizing effect, as per above, while with a content higher than 50% w/w some problems could rise in dissolving the copolymer in water (used alone or mixed with other water-miscible auxiliary solvents, such as e.g. methanol, ethanol, dimethylformamide and acetone and/or with addition of other organic solvents partially soluble in water, such as e.g. benzyl alcohol and phenylcellosolve). The preferred weight contents range from 5 to 50. A supersensitizing or stabilizing amount of the copolymer is used in the emulsion. This varies somewhat between copolymers, but is preferably at least 25 mg/mole Ag, more preferably at least 75 mg/mole Ag and most preferably at least 125 mg/mole Ag.

Typical polymeric products which can be used according to the present invention are the polymeric products described in Table 1 wherein the monomer copolymerized (in solution in the presence of a polymerization initiator) with an aminoallylidenmalononitrile moiety, as well as the weight percent quantity of aminoallylidenmalononitrile moieties (AAMM) within the polymers themselves are indicated.

TABLE 1

| Compound | Monomer | % of AAMN |
|---|---|---|
| I | acrylamide | 9 |
| II | methacrylic acid | 11 |
| III | acrylamide | 10.5 |
| IV | acrylic acid | 23 |
| V | acrylamide | 44 |
| VI | vinylpyrrolidone | 44 |
| VII | vinyloxazolidone | 14.5 |
| VIII | vinyloxazolidone | 37 |
| IX | methacrylamide | 8 |
| X | acrylamide-allylamine chlorohydrate | 10 |
| XI | acrylamide-diallylamine chlorohydrate | 7 |

The above compounds have been prepared as follows:

Synthesis of 3-diallylaminoallylidenmalononitrile intermediate (A).

A solution of 97.2 g (equal to 1 mole) of diallylamine and 237.2 g (equal to 1 mole) of 3-acetanilido-allylidenmalononitrile in 600 ml of ethanol was boiled to reflux for 20 minutes. After that, 110 ml of conc. hydrochloric acid were added thereto and the mixture was refluxed for 20 minutes. The so-obtained mixture was then poured into an excess of water and ice. The precipitate was filtered in the air and the obtained product was crystallized from an ethylene glycol monomethyl ether/water 2:1 mixture. Yield 63%. M.P. 50°-52° C. A solution in methyl alcohol diluted 1:350,000 gave an optical density of 0.83 at 377 nm. with a molar extinction coefficient of $6.3.10^4$. (The weight quantities of the aminoallylidenmalononitrile moieties in the copolymers of the following examples were calculated on the ground of optical density measurements considering said molar extinction coefficient unchanged after the copolymerization).

Preparation of the (acrylamide-allylaminoallylidenmalononitrile) copolymer (Compound 1)

A solution of 120 g of acrylamide and 114 g of 3-diallylaminoallylidenmalononitrile (A) in 500 ml of ethanol was brought to reflux. 3.2 g of 2,2'-azobisisobutyrronitrile (AZBN) were added thereto and the mixture was left to reflux for 1 hour under stirring. A solution of 104 g of acrylamide, 800 ml of ethanol and 3.2 g of AZBN was then introduced therein. The obtained solution was left to reflux for 1 hour under stirring. A solution of 88 g of acrylamide, 400 ml of ethanol and 2.4 g of AZBN was introduced therein and the solution was left to reflux for 1 hour. A solution of 72 g of acrylamide, 400 ml of ethanol and 1.6 g of AZBN was added thereto and the obtained solution was left to reflux for 1 hour. A solution of 56 g of acrylamide, 400 ml of ethanol and 1.6 g of AZBN was finally added thereto and the obtained solution was left to reflux for 2 hours. The so-obtained mixture was cooled, filtered, washed with ethanol and then with ethyl ether and dried under vacuum at 50° C., thus obtaining 478 g of a water soluble product containing about 9% w/w of aminoallylidenmalononitrile moieties.

Preparation of the methacrylic acid (allylaminoallylidenmalononitrile) copolymer (Compound II).

A solution of 60 g of methacrylic acid and 60 g of 3-diallylaminoallylidenmalononitrile (A) in 300 ml of ethanol was brought to reflux. 6 g of AZBN were then added thereto and the mixture was washed to reflux for 18 hours. The mixture was then cooled, saturated with ether, precipitated in ether, washed with ether and dried at 50° C. under vacuum. 70 g of a product soluble in water and NaOH at pH=7, were obtained which contained about 11% w/w of aminoallylidenemalononitrile moieties.

Preparation of the (acrylamide-diallyl-aminoallylydenmalononitrile) copolymer (Compound III).

52 g of intermediate (A) and 26 g of acrylamide were dissolved in 900 ml of ethanol and added with 1 g of lauroylperoxide and heated to reflux in a flask provided with stirrer and reflux condenser. After one hour, 24 g of acrylamide in 100 ml of ethanol and 0.8 g of lauroylperoxide were added thereto. Continuing the reflux heating, at intervals of 1 hour, the following additions were then made:

22 g of acrylamide in 100 ml of ethanol and 0.7 of lauroylperoxide;

20 g of acrylamide and 0.7 g of lauroylperoxide in 100 ml of ethanol;

18 g of acrylamide and 0.7 g of lauroylperoxide in 100 ml of ethanol;

16 g of acrylamide and 0.7 g of lauroylperoxide in 75 ml of ethanol;

14 g of acrylamide and 0.7 g of laurolylperoxide in 75 ml of ethanol.

After the last addition, the mixture was left to reflux for 2 hours, then cooled at room temperature, filtered, the product was washed first with ethanol, then with acetone and finally dried. The yield was 112 g of a product soluble in 70/30 water/ethanol containing about 10.5% w/w of aminoallylidenmalononitrile moieties.

Preparation of the (acrylic acid-diallylyaminoallylidenmalononitrile) copolymer (Compound IV)

60 g of intermediate (A) and 20 g of acrylic acid were dissolved in 120 ml of ethanol in a flask provided with a stirrer and reflux condenser and added with 2 g of lauroylperoxide; the mixture was then heated to reflux and after one hour added with 16 g of acrylic acid and 1 g of lauroylperoxide dissolved in 20 ml of ethanol. Continuing the reflux heating, at an interval of one hour, the following additions were made: 13 g of acrylic acid and 1 g of laurolylperoxide in 20 ml of ethanol: 10 g of acrylic acid and 0.8 g of laurolylperoxide in 15 ml of ethanol; 8 g of acrylic acid and 0.8 g of lauroylperoxide in 10 ml of ethanol. After the last addition, the reflux was maintained for 2 hours, then the mixture was cooled and precipitated in ethyl ether. The precipitate was collected on a filter, washed with ether and dried under vacuum at 50° C. The yield was 49 g of a product containing about 23% w/w of aminoallylidenmalononitrile moieties. The product resulted to be soluble in water and NaOH at pH 7.

Preparation of the (acrylamide-diallyl-aminoallylidenmalononitrile) copolymer (Compound V).

50 g of intermediate (A) and 2 g of acrylamide, dissolved in 100 ml ethanol and added with 0.5 g of azobisisobutyrronitrile, were heated to reflux in a flask provided with a stirrer and reflux condenser. Each 30 minutes, under reflux heating, 2 g of acrylamide dissolved in 10 ml of ethanol were added thereto up to a total of 12 additions. Addition no. 6 contained also 0.5 g of AZBN. The so-obtained mixture was cooled, the separated product was collected, washed accurately with ether, dried under vacuum at 50° C. The yield was 32 g of a product soluble in 50:50 water-acetone, containing about 44% w/w of aminoallylidenmalononitrile moieties.

Preparation of the (N-vinylpyrrolidone-diallylaminoallylidenmalononitrile) copolymer (Compound VI).

25 g of intermediate (A) and 25 g of vinylpyrrolidone were dissolved in 100 ml of N-methylpyrrolidone and added with 2.5 g of AZBN. The mixture was then heated to reflux at 85° C. for 6 hours in a flask provided with a stirrer and reflux condenser, then it was cooled, precipitated in ether and dried at 50° C. The yield was 15.7 g of a product soluble in 40:60 water-ethanol, containing about 44% w/w of aminoallylidenmalononitrile moieties.

Preparation of the (N-vinyloxazolidone-diallylaminoallylidenmalononitrile) copolymer (Compound VII).

25 g of intermediate (A) and 25 g of vinyloxazolidone were dissolved in 150 ml of ethanol and added with 2.5 g of AZBN. The mixture was heated to reflux for 24 hours in a flask provided with stirrer and reflux condenser. At the end, it was cooled, precipitated in ether, washed and dried. The yield was 14.5 g of a product soluble in water and dimethylformamide, containing about 45% w/w of aminoallylidenmalononitrile moieties.

Preparation of the (vinyloxazolidone-diallylaminoallylidenmalononitrile) copolymer (Compund VIII).

25 g of intermediate (A) and 50 g of vinyloxazolidone were dissolved in 150 ml of N-methylpyrrolidone and added with 3.75 g of AZBN. The mixture was heated at 85° C. for 24 hours in a flask provided with stirrer and reflux condenser. The product was cooled, precipitated in ethyl ether (2 liters), washed with ether and dried. It was then redissolved in DMF and re-precipitated in ethyl ether. The yield was 32.7 g of a product soluble in water and dimethylformamide, containing about 37% w/w of aminoallylidenmalononitrile moieties.

Preparation of the (methacrylamide-diallylaminoallylidenmalononitrile) copolymer (Compound IX).

In a 10 l flask, provided with stirrer, reflux condenser and internal thermometer, 230 g of methacrylamide and 120 g of 3-diallylaminoallylidenmalononitrile (A) were dissolved in 4 l of 96% ethanol. The mixture temperature was arranged to 78° C. under stirring. At this point, 8 g of 2,2'-azobisisobutyrronitrile (AZBN) were introduced therein. After 10 minutes, a pale yellow product began to separate. The reaction was continued under these conditions for 14 hours. The mixture was then cooled at room temperature; the separated product was filtered, washed with diethyl ether and dried under vacuum at 50° C. The yield of the pale yellow solid product, soluble in 70/30 water/ethanol, was 290 g, containing about 8% w/w of the aminoallylidenemalononitrile moieties.

Preparation of the (3-diallylaminoallylidenmalononitrile-acrylamide-allylamine chlorohydrate) terpolymer (Compound X).

40 g of intermediate (A) and 10.6 g of allylamine in 580 ml of ethanol and 19.6 ml of 37% hydrochloric acid were dissolved in a flask provided with a stirrer and reflux condenser. Under stirring and raising the mixture temperature up to 90° C., a solution of 107.7 g of acrylamide and 4.2 g of 2.2'-azobisisobutyrronitrile in 648 ml of ethanol was added thereto. The reaction mixture was kept at 90° C. for 20 hours and then poured into 2 liters of acetone; the precipitated product was grinded and washed upon decantation with one liter of acetone, filtered and dried. 108.6 g of a water soluble product were obtained, containing about 10% w/w of aminoallylidenmalononitrile moieties.

Preparation of the (3-diallylamino-allylidenmalononitrile-acrylamide-diallylamine chlorohydrate) terpolymer (Compound XI).

34.6 g of intermediate (A) and 9.2 g of diallylamine were dissolved in 500 ml of ethanol and 9.5 ml of 37% hydrochloric acid in a flask provided with a stirrer and reflux condenser. Under stirring and raising the temperature up to 90° C., 93.2 g of acrylamide and 3.6 g of 2.2'-azobisisobutyrronitrile in 500 ml of ethanol were added thereto. The reaction mixture was kept at 90° C. for 20 hours and then poured in 2 liters of acetone; the precipitated product was grinded and washed with acetone upon decantation; it was then filtered and dried. The yield was 109 g of a water soluble product, containing about 7% w/w of aminoallylidenmalononitrile moieties.

The methyne dye sensitizers of the present invention are represented by the common spectrally sensitizing dyes used in silver halide emulsions, which include cyanine dyes and merocyanine dyes as well as other dyes as described by F. M. Hamer in "The Cyanine Dyes And Related Compounds", Interscience Publishers (1964). As said before, however, preferred dyes to the purposes of the present invention are reported by the following formula:

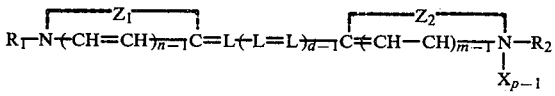

wherein n and m each represent a positive integer of from 1 to 2; L represents a methine linkage, e.g. =CH—, =C(CH$_3$)—, =C(C$_2$H$_5$)—, etc.; R$_1$ and R$_2$ each represents an alkyl group, represented by a substituted or non-substituted alkyl, (preferably a lower alkyl containing from one to four carbon atoms), e.g. methyl, ethyl, propyl, butyl, cyclohexyl, dodecyl, etc., a hydroxyalkyl group, e.g. β-hydroxyethyl, ω-hydroxybutyl, etc.; an alkoxyalkyl group, e.g. β-methoxyethyl, ω-buthoxyethyl, etc.; a carboxyalkyl group, e.g. β-carboxyethyl, ω-carboxybutyl, etc.; a sulfoalkyl group, e.g. β-sulfoethyl, ω-sulfobutyl, etc.; a sulfatoalkyl group, e.g. β-sulfatoethyl, ω-sulfatobutyl, etc.; an acyl oxyalkyl group, e.g. β-acetoxyethyl, γ-acetoxypropyl, ω-butyryloxybutyl, etc.; an alkoxycarbonylalkyl group, e.g. β-methoxycarbonylethyl, ω-ethoxycarbonyl-butyl, benzyl, phenethyl, etc., or an aryl group of up to 30 carbon atoms, e.g. phenyl, tolyl, xylyl, chlorophenyl, naphthyl, etc.; X represents an acid anion, e.g. chloride, bromide, iodide, thiocyanate, sulfamate, perchlorate, p-toluenesulfonate, methylsulfate, etc.; d represents a positive integer of from 1 to 2; said methine dye forming an intramolecular salt when p is 1; Z$_1$ and Z$_2$ each represents the non metallic atoms necessary to complete the same or different simple or condensed 5 to 6 membered heterocyclic nuclei, such as those used in cyanine dyes, which nucleus may contain a second hetero atom, such as oxygen, sulfur, selenium or nitrogen such as the following nuclei: a benzothiazole nucleus (e.g. benzothiazole, 3-, 5-, 6- or 7-chlorobenzothiazole, 4-, 5- or 6-methylbenzothiazole, 5- or 6-bromobenzothiazole, 4- or 5-phenylbenzothiazole, 4-, 5- or 6-methoxybenzothiazole, 5- or 6-iodobenzothiazole, 4- or 5-ethoxybenzothiazole, 5,6-dimethylbenzothiazole, 5-or 6-hydroxybenzothiazole, etc.), a naphthothiazole nucleus (e.g. naphthothiazole, β-naphthothiazole, 5-methoxy-β-naphthothiazole, 5-ethoxy-α-naphthothiazole, 8-methoxy-α-naphthothiazole, 7-methoxy-α-naphthothiazole, etc.), a benzoselenazole nucleus (e.g. benzoselenazole, 5-chloro-benzoselenazole, tetrahydrobenzoselenazole, etc.), a naphthoselenazole nucleus (e.g. α-naphthoselenazole, β-naphthoselenazole, etc.), a benzoxazole nucleus (e.g. benzoxazole, 5- or 6-hydrobenzoxazole, 5-chloro-benzoxazole, 5- or 6-methoxybenzoxazole, 5-phenyl-benzoxazole, 5,6-dimethyl-benzoxazole, etc.), a naphthoxazole nucleus (e.g. α-naphthoxazole, β-naphthoxazole, tc.), a 2:quinoline nucleus (e.g. 2-quinoline, 6-, 7- or 8-methyl-2-quinoline, 4-, 6- or 8-chloro-2-quinoline, 5-, 6- or 7-ethoxy-2-quinone, 6- or 7-hydroxy -2-quinoline, etc.), a 4-quinoline nucleus (e.g. 4-quinoline, 7- or 8-methyl-4-quinoline, 6-methoxy-4-quinoline etc.), a benzimidazole nucleus (e.g. benzimidazole, 5-chloro-benzimidazole, 5,6-dichloro-benzimidazole, etc.), a thiazole nucleus (e.g. 4- or 5-methylthiazole, 5-phenyl-thiazole, 4,5-dimethyl-thiazole, etc.), an oxazole nucleus (e.g. 4- or 5-methyl-oxazole, 4-phenyl-oxazole, 4-ethyloxazole, 4,5-dimethyl-oxazole, etc.), a selenazole nucleus (e.g. 4-methyl-selenazole, 4-phenyl-selenazole, etc.), and the like. More preferred dyes within the above described class are those having an internal salt group and/or derived from benzoxazole and benzimidazole nuclei as indicated before. Typical methine spectral sensitizing dyes of the invention include those listed in the following Table 2.

TABLE 2

| Dye | Cyanine Spectral Sensitizing Dye |
|---|---|
| A | 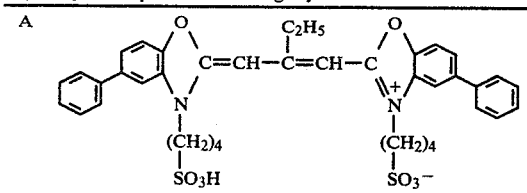 |
| B | 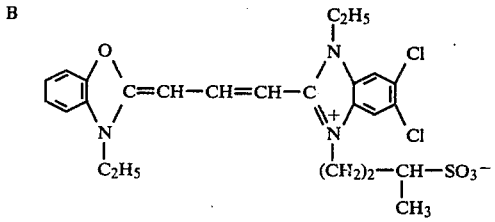 |
| C | 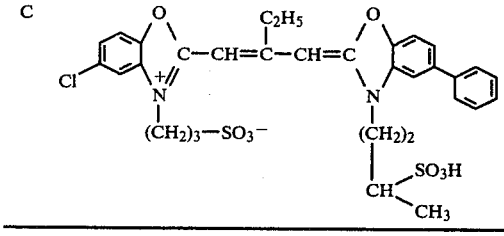 |

The methine spectral dye sensitizers of the invention are generally known to the skilled in the art. Particular reference can be made to the following patents: U.S. Pat. No. 2,503,776, French Pat. No. 1,118,778, U.S. Pat. No. 2,912,329, U.S. Pat. No. 3,148,187, U.S. Pat. No. 3,397,060 U.S. Pat. No. 3,573,916, U.S. Pat. No. 3,822,136. Also their use in photographic emulsions is very known wherein they are used in optimum concentrations corresponding to desired values of sensitivity to fog ratios. Optimum or near optimum concentrations of the spectral sensitizing dyes in the emulsions of the present invention generally go from 10 to 1000 mg per mole of silver, preferably from 50 to 500, more preferably from 50 to 200, while optimum concentrations of the polymeric products of the present invention generally go from 10 to 1000 mg per mole of silver, preferably from 50 to 500, more preferably from 150 to 350, the ratio of the polymeric product to the dye sensitizer (weight to weight) normally being of 10/1 to 1/10, preferably of 5/1 to 1/5, more preferably of 2.5/1 to 1/1 (such ratio of course depending upon the aminoallylidenmalononitrile moiety content of the polymeric product: the higher such content, the lower such ratio).

Minimum values of sensitizing or stabilizing quantities of the polymeric compounds of the invention can be experimentally determined by appearance of the desired effect, while maximum quantities can be experimentally determined by appearance of non desired effects, such as fog or non desired sensitivity in certain regions of the visible spectrum (for example, in X-ray photographic elements sensitized to blue and green, sensitivity to red is undesirable).

As known to the skilled in the art, the sensitizer dyes can be introduced into the photographic emulsion coating composition, dissolved in methanol or ethanol or dispersed in gelatin as described in U.S. Pat. Nos. 3,469,987 and 3,660,101.

The polymeric compound of the present invention can be introduced into the photographic emulsion (before coating) from water solutions thereof. It has been experimentally observed that better results are achieved when the addition of such polymeric compound follows the addition of the sensitizer dyes.

The invention is not limited to a particular type of emulsion or silver halide. It can find application in various types of emulsion materials, as for example described in Research Disclosure 17643, paragraph 1, Dec. 1978. The emulsions may be chemically and optically sensitized as described in Research Disclosure 17643 (RD 17643), paragraphs III and IV, Dec. 1978; they can include optical brighteners, antifog agents and stabilizers, filter and antihalo dyes, hardeners and coating agents, plasticizers and lubricants and other auxiliary agents, as for example described in RD 17643, paragraphs V, VI, VIII, X, XI and XII.

Both the emulsion and the auxiliary layers can include various colloidal substances alone or combined with other binding materials, as described in RD 17643, paragraph IX and the emulsions may include colour couplers as described in paragraph VII. They can be coated on a plurality of support bases with various coating methods as described in paragraph XV and XVII and the obtained coated elements can be processed in various ways after exposure as described in paragraph XX.

As said before, however, the best application of the present invention turned out to be, in the Applicant's experience, an X-ray photographic emulsion spectrally sensitized to the green region of the light (the sensitivity to blue is intrinsic to the silver halide grains and does not need an optical sensitizer associated therewith) including silver bromo-iodide grains having up to 2.5 percent of iodide preferably from 2.0 to 2.3.

EXAMPLE 1

A silver bromo-iodide emulsion containing 98.0% of silver bromide and 2.0% of silver iodide and having a mean grain size of approximately 0.8 $\mu$, dispersed in gelatin, ripened, washed and chemically sensitized, was spectrally sensitized by the addition of 31 mg/mole of silver of the dye A and 83 mg/mole of silver of the dye B and added with the conventional coating finals, such as stabilizers, antifoggants, wetting agents, hardeners, etc. Said emulsion was then coated with a silver coating weight of 3 g/m$^2$ on both sides of a subbed polyester silm support; a gelatin protective overcoat at a coverage of 1.54 g of gelatin per square meter comprising an antistatic composition as described in example 2 I of the Italian Pat. No. 966,734, was then coated on said emulsion layers in order to obtain a double coated blue-green sensitive radiographic film (film a). Two other radiographic films were prepared as described above and having incorporated in the silver bromo-iodide emulsion respectively 166 and 332 mg/mole of silver of the compound 1 added after the two dyes above (films b and c). Samples of the films a, b and c were placed into a radiographic cassette with the faces of the film in intimate contact with two 3M T8 Trimax Intensifying Screens. The films were exposed in the cassette at a distance of one meter from an X-ray source working at 80 KV, through an aluminium wedge. The samples of the films were then treated in a commercially available developer solution in a 3M XP 504 Processor. The sensitometric results are shown in the following table:

| Film | mg/Ag mole Compound 1 | Fog | $D_{max}$ | Av. Contrast | Speed | ΔSpeed lgE |
|---|---|---|---|---|---|---|
| a | — | 0.26 | 3.58 | 2.70 | 15.30 | 0 |
| b | 166 | 0.24 | 3.58 | 2.60 | 15.50 | +0.02 |
| c | 332 | 0.25 | 3.54 | 2.80 | 16.20 | +0.09 |

EXAMPLE 2

A silver halide bromo-iodide emulsion containing 97.7% of silver bromide and 2.3% of silver iodide and having a mean grain size of approximately 0.8$\mu$, dispersed in gelatin, ripened, washed and chemically sensitized, was spectrally sensitized by the addition of 32 mg/mole of silver of the dye A and 81 mg/mole of silver of the dye B, added with the conventional coating finals and coated as described in example 1, with the same protective overcoat in order to obtain a radiographic film (film a). A second radiographic film was prepared similarly to film a, but the silver bromo-iodide emulsion had been stored at 42° C. for 6 hours prior to coating (film b). A third radiographic film was prepared as film a above, but having incorporated in the silver bromo-iodide emulsion 168 mg/mole of silver of the compound I (film c). A fourth radiographic film was prepared similarly to film c, but the silver bromo-iodide emulsion, containing incorporated therein 168 mg/mole of silver of the compound I, had been stored at 42° C. for 6 hours prior to coating (film d). A fifth radiographic film was prepared as film a above, but having incorporated in the silver bromo-iodide emulsion 225 mg/mole of silver of the compund I (film e). At last, a sixth radiographic film was prepared similarly to film e, but the silver bromo-iodide emulsion, containing incorporated therein 225 mg/mole of silver of the compound I, had been stored at 42° C. for 6 hours prior to coating (film f). Samples of the films a, b, c, d, e and f were processed as described in example 1; the sensitometric results are shown in the following table:

| Film | mg/Ag mole compound 1 | Fog | Dmax | Speed | ΔSpeed |
|---|---|---|---|---|---|
| a | — | 0.21 | 3.45 | 12.80 | 0 |
| b | — | 0.21 | 3.40 | 12.60 | −0.02 |
| c | 168 | 0.20 | 3.40 | 13.00 | +0.02 |
| d | 168 | 0.21 | 3.42 | 13.00 | +0.02 |
| e | 225 | 0.20 | 3.45 | 13.45 | +0.065 |
| f | 225 | 0.21 | 3.45 | 13.45 | +0.065 |

EXAMPLE 3

A silver bromo-iodide emulsion containing 97.7% of silver bromide and 2.3% of silver iodide was prepared as described in example 2; then it was spectrally sensitized by the addition of 32 mg/mole of silver of the dye A and 81 mg/mole of silver of the dye B, and added with the conventional finals, such as stabilizers, antifoggants, wetting agents, hardeners, etc. Said emulsion, after having been stored at 42° C. for 4 hours, was coated as described in example 1 with the same protective overcoat in order to obtain a radiographic film (film a). Two other radiographic films were prepared as described above and having incorporated in the silver bromo-iodide emulsion respectively 225 and 337 mg/mole of silver of the compound I added after the two days (films b and c). Samples of the films were processed as described in example 1; the sensitometric results are shown in the following table:

| Film | mg/Ag mole compound I | Fog | Dmax | Speed | ΔSpeed lgE | Av. Contrast |
|---|---|---|---|---|---|---|
| a | — | 0.18 | 3.20 | 12.80 | 0 | 2.2 |
| b | 225 | 0.17 | 3.30 | 13.40 | +0.06 | 2.3 |
| c | 337 | 0.18 | 3.20 | 13.50 | +0.07 | 2.3 |

EXAMPLE 4

A silver bromo-iodide emulsion containing 97.7% of silver bromide and 2.3% of silver iodide, prepared as described in example 2, was spectrally sensitized with 58 mg/mole of silver of the dye A and added with the conventional coating finals. Said emulsion, after having been stored at 42° C. for 4 hours, was coated as described in example 1, with the same protective overcoat in order to obtain a radiographic film (film a). Two other radiographic films were prepared as described above and having incorporated in the silver bromo-iodide emulsion respectively 225 and 237 mg/mole of silver of the compound I. Samples of the films were processed as described in example 1; the sensitometric results are shown in the following table:

| Film | mg/Ag mole compound I | Fog | Dmax | Speed | ΔSpeed lgE | Av. Contrast |
|---|---|---|---|---|---|---|
| a | — | 0.17 | 3.32 | 13.10 | 0 | 2.5 |
| b | 225 | 0.17 | 3.25 | 13.50 | +0.04 | 2.4 |
| c | 237 | 0.17 | 3.20 | 13.60 | +0.05 | 2.4 |

EXAMPLE 5

A silver bromo-iodide emulsion containing 97.7% of silver bromide and 2.3% of silver iodide, prepared as described in example 2, was spectrally sensitized with 126 mg/mole of silver of the dye B and added with the conventional coating finals. Said emulsion, after having been stored at 42° C. for 4 hours, was coated as described in example 1, with the same protective overcoat in order to obtain a radiographic film (film a). Two other radiographic films were prepared as described above and having incorporated in the silver bromo-iodide emulsion respectively 225 and 237 mg/mole of silver of the compound I. Samples of the films were processed as described in example 1; the sensitometric results are shown in the following table:

| Film | mg/Ag mole compound I | Fog | Dmax | Speed | ΔSpeed lgE | Av. Contrast |
|---|---|---|---|---|---|---|
| a | — | 0.17 | 3.20 | 12.70 | 0 | 2.5 |
| b | 225 | 0.17 | 3.25 | 12.95 | +0.025 | 2.6 |
| c | 337 | 0.18 | 3.20 | 13.05 | +0.035 | 2.6 |

EXAMPLE 6

A silver bromo-iodide emulsion containing 97.7% of silver bromide and 2.3% of silver iodide, prepared as described in example 2, was spectrally sensitized with 112 mg/mole of silver of the dye C, and added with the conventional coating finals. Said emulsion, after having been stored at 42° C. for 4 hours, was coated as described in example 1, with the same protective overcoat in order to obtain a radiographic film (film a). Two other radiographic films were prepared as described above, having incorporated in the silver bromo-iodide emulsion respectively 225 and 337 mg/mole of silver of the comound I. Samples of the films were processed as described in example 1; the sensitometric results are shown in the following table:

| Film | mg/Ag mole compound I | Fog | Dmax | Speed | ΔSpeed lgE | Av. Contrast |
|---|---|---|---|---|---|---|
| a | — | 0.17 | 3.20 | 13.00 | 0 | 2.4 |
| b | 225 | 0.17 | 3.20 | 13.40 | +0.04 | 2.4 |
| c | 337 | 0.18 | 3.25 | 13.80 | +0.08 | 2.4 |

EXAMPLE 7

Different portions of the same batch of silver halide emulsion, containing 97.7% of silver bromide and 2.3% of silver iodide, dispersed in gelatin, ripened, washed, chemically sensitized, spectrally sensitized with 32 mg/mole of silver of the dye A and 81 mg/mole of silver of the dye B, added with conventional coating finals, were added with the polymeric product of table 1, in the proportions given in the table hereinafter. In each case, after having been stored at 42° C. for 4 hours, the emulsion was coated as described in example 1 with the same protective overcoat in order to obtain a radiographic film. A sample of each film was processed as described in example 1; the sensitometric results are shown in the following table:

| Film | Pol. Comp. of Table 1 and conc. (mg/Ag mole) | Fog | Dmax | Speed | ΔSpeed lgE | Av. Contrast |
|---|---|---|---|---|---|---|
| a | — | 0.19 | 3.45 | 13.00 | 0 | 2.40 |
| b | I (0.255) | 0.18 | 3.49 | 13.55 | +0.055 | 2.40 |
| c | I (0.337) | 0.19 | 3.48 | 13.70 | +0.070 | 2.40 |
| d | II (0.255) | 0.18 | 3.44 | 13.52 | +0.052 | 2.40 |
| e | II (0.337) | 0.18 | 3.50 | 13.55 | +0.055 | 2.40 |
| f | III (0.255) | 0.18 | 3.52 | 13.32 | +0.032 | 2.50 |

-continued

| Film | Pol. Comp. of Table 1 and conc. (mg/Ag mole) | Fog | Dmax | Speed | ΔSpeed lgE | Av. Contrast |
|---|---|---|---|---|---|---|
| g | III (0.337) | 0.18 | 3.55 | 13.47 | +0.047 | 2.45 |
| h | IV (0.255) | 0.18 | 3.50 | 13.22 | +0.022 | 2.50 |
| i | IV (0.337) | 0.18 | 3.40 | 13.32 | +0.032 | 2.35 |
| l | V (0.255) | 0.17 | 3.50 | 13.25 | +0.025 | 2.40 |
| m | V (0.337) | 0.18 | 3.50 | 13.62 | +0.062 | 2.40 |
| n | VI (0.255) | 0.19 | 3.55 | 13.57 | +0.057 | 2.45 |
| o | VII (0.255) | 0.19 | 3.44 | 13.55 | +0.055 | 2.35 |
| p | VIII (0.255) | 0.20 | 3.50 | 13.45 | +0.045 | 2.30 |
| q | IX (0.255) | 0.17 | 3.50 | 13.30 | +0.030 | 2.40 |
| r | IX (0.337) | 0.18 | 3.50 | 13.32 | +0.032 | 2.40 |
| s | X (0.255) | 0.18 | 3.40 | 13.25 | +0.025 | 2.45 |
| t | X (0.337) | 0.18 | 3.50 | 13.35 | +0.035 | 2.45 |
| u | XI (0.255) | 0.18 | 3.50 | 13.22 | +0.022 | 2.50 |
| v | XI (0.337) | 0.18 | 3.50 | 13.40 | +0.040 | 2.45 |

I claim:

1. A photographic emulsion including silver halide grains dispersed in gelatin and at least one methine dye spectral sensitizer associated with said grains characterized by the fact that it contains associated therewith a supersensitizing or stabilizing amount of a polymeric compound including an aminoallylidenmalononitrile moiety.

2. A photographic silver halide emulsion of claim 1 characterized by the fact that said polymeric compound is obtained upon copolymerization of an allyl monomer including said aminollylidenmalononitrile moiety with an ethylenically unsaturated monomer.

3. A photographic silver halide emulsion of claim 2 characterized by the fact that said polymeric compound is obtained upon copolymerization of 3-diallylaminoallylidenmalononitrile with a water soluble ethylenically unsaturated monomer.

4. A photographic silver halide emulsion of claim 3 characterized by the fact that said polymeric compound is obtained upon solution copolymerization.

5. A photographic silver halide emulsion of claim 2 characterized by the fact that said polymeric compound is water soluble.

6. A photographic silver halide emulsion of claim 2 characterized by the fact that said ethylenically unsaturated monomer is an acrylic or methacrylic monomer.

7. A photographic silver halide emulsion of claim 6 characterized by the fact that said acrylic monmer is acrylamide or acrylic acid.

8. A photographic silver halide emulsion of claim 1 characterized by the fact that said dye has the following formula:

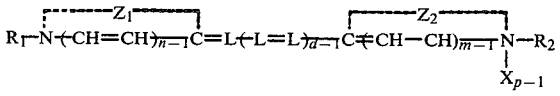

wherein n, m and p each represents a positive integer of from 1 to 2; L represents a methine linkage; $R_1$ and $R_2$ each represents a member selected from the group consisting of an alkyl group and an aryl group; X represents an acid anion; d represents a positive integer from 1 to 3; p represents a positive integer of from 1 to 2, said spectral sensitizing dye forming an intramolecular salt when p is 1; and $Z_1$ and $Z_2$ represent the non-metallic atoms necessary to complete a simple or condensed nitrogen containing 5 or 6-membered heterocyclic nucleus of the type used in cyanine dyes.

9. A photographic silver halide emulsion of claim 8 characterized by the fact that said dye is a carbocyanine benzoxazole dye including at least one intramolecular salt group linked to the positive nitrogen atom thereof.

10. A photographic element including a support base and a silver halide emulsion, characterized by the fact that said emulsion is one of claim 1.

11. A photographic element of claim 10 for radiographic use characterized by the fact that said support is coated on both sides with silver halide emulsions of claim 1 overcoated with nonsensitive protective layers.

* * * * *

UNITED STATES PATENT AND TRADEMARK OFFICE

CERTIFICATE OF CORRECTION

PATENT NO. : 4,307,183

DATED : December 22, 1981

INVENTOR(S) : Gerolamo Delfino

It is certified that error appears in the above—identified patent and that said Letters Patent is hereby corrected as shown below:

Col. 8, line 11, "tc." should be deleted and --etc.-- inserted in its place.

Col. 8, line 11, "2:quinoline" should be deleted and --2-quinoline-- inserted in its place.

Col. 10, line 9, "2 1" should be deleted and --2-- inserted in its place.

Col. 11, line 27, "days" should be deleted and --dyes-- inserted in its place.

Col. 12, line 30, "comound" should be deleted and --compound-- inserted in its place.

Signed and Sealed this

*Eighteenth* Day of *January 1983*

[SEAL]

*Attest:*

GERALD J. MOSSINGHOFF

*Attesting Officer*

*Commissioner of Patents and Trademarks*